US006928905B1

(12) United States Patent
Hsien

(10) Patent No.: US 6,928,905 B1
(45) Date of Patent: Aug. 16, 2005

(54) REINFORCEMENT STRUCTURE FOR ADJUSTABLE WRENCHES

(76) Inventor: Chih-Ching Hsien, No. 367, Pei Yang Road, Feng Yuan, Taichung (TW)

( * ) Notice: Subject to any disclaimer, the term of this patent is extended or adjusted under 35 U.S.C. 154(b) by 0 days.

(21) Appl. No.: 10/854,199

(22) Filed: May 27, 2004

(51) Int. Cl.[7] ..... B25B 13/16
(52) U.S. Cl. ..... 81/165; 81/129; 81/170
(58) Field of Search ..... 81/165, 129, 170, 81/133, 157, 138

(56) References Cited

U.S. PATENT DOCUMENTS 1,133,236 A * 3/1915 Peterson ..... 81/165
2,708,856 A * 5/1955 Brynge ..... 81/165
2,720,805 A * 10/1955 Brynge ..... 81/165
6,382,056 B1 * 5/2002 Wu ..... 81/165
6,470,773 B1 * 10/2002 Wu ..... 81/165
6,789,451 B1 * 9/2004 Wu ..... 81/157

* cited by examiner

*Primary Examiner*—Joseph J. Hail, III
*Assistant Examiner*—Alvin J Grant

(57) ABSTRACT

An adjustable wrench includes a handle with a fixed jaw extending from a head of the wrench and a groove is defined in an end of the head and communicates with a through hole defined transversely through the head. The through hole forms a circular hole in an outer surface of the head and located beside a root portion of the fixed jaw. A movable jaw has a cylindrical rack piece which is movably inserted in the groove and the through hole. A flange is connected between the movable jaw and the rack piece. A thumb screw is rotatably engaged with a hole defined through the head and engage with the rack piece.

1 Claim, 4 Drawing Sheets

REINFORCEMENT STRUCTURE FOR ADJUSTABLE WRENCHES

FIELD OF THE INVENTION

The present invention relates to an adjustable wrench wherein the through hole for receiving the rack piece of the movable jaw forms a circular hole in an outside of the head.

BACKGROUND OF THE INVENTION

A conventional adjustable wrench is disclosed in FIGS. 6 and 7, and generally includes a handle 50 and a head 51 integrally connected to an end of the handle 50. A fixed jaw 52 extends from the head 51 and a groove 53 is defined in the head 51. A through hole 54 is defined through the head 51 and located parallel to and in communication with the groove 53. A recess 55 is defined radially and in communication with the through hole 54 and extends into the fixed jaw 52 so as to form a space 550 for receiving the flange 62 of a movable jaw 60 which will be described hereinafter. The movable jaw 60 includes a rack piece 61 and a flange 62 extends from the rack piece 61 and connected to a root of the movable jaw 60. The rack piece 61 is movably inserted in the groove 53 and the through hole 54 and a thumb screw 70 is rotatably connected to the head 51 and engaged with the rack piece 61 so that the movable jaw 60 moves toward or away from the fixed jaw 52 by rotating the thumb screw 70. The recess 55 and the space 550 in the fixed jaw 52 receive the flange 62 on the movable jaw 60 when the movable jaw 60 is matched with the fixed jaw 52. The fixed jaw 52 experiences significant pressure during use and experience has shown the fixed jaw 52 tends to be broken at the root portion thereof after a period of use of the wrench. The damage to the fixed jaw 52 results from that the recess 55 and the space 550 which weakens the structural strength of the fixed jaw 52. Besides, the recess 55 and the space 550 require a lot of machining.

The present invention intends to provide an adjustable wrench wherein there is no recess as shown in the conventional wrench and the through hole only makes a circular hole in an outer surface of the head. The flange on the movable jaw is shorter than that of the conventional one so that the fixed jaw needs not to be machined a recess and the structural strength of the fixed jaw is reinforced.

SUMMARY OF THE INVENTION

The present invention relates to an adjustable wrench which comprises a handle with a head on an end thereof and a fixed jaw extends from the head. A groove is defined in an end of the head and a through hole is defined transversely through the head and communicates with the groove. The through hole forms a circular hole in an outer surface of the head. A movable jaw has a cylindrical rack piece and a flange is connected between the movable jaw and the rack piece. The rack piece is movably inserted in the groove and the through hole. A thumb screw is rotatably engaged with a hole defined through the head and engages with the rack piece.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
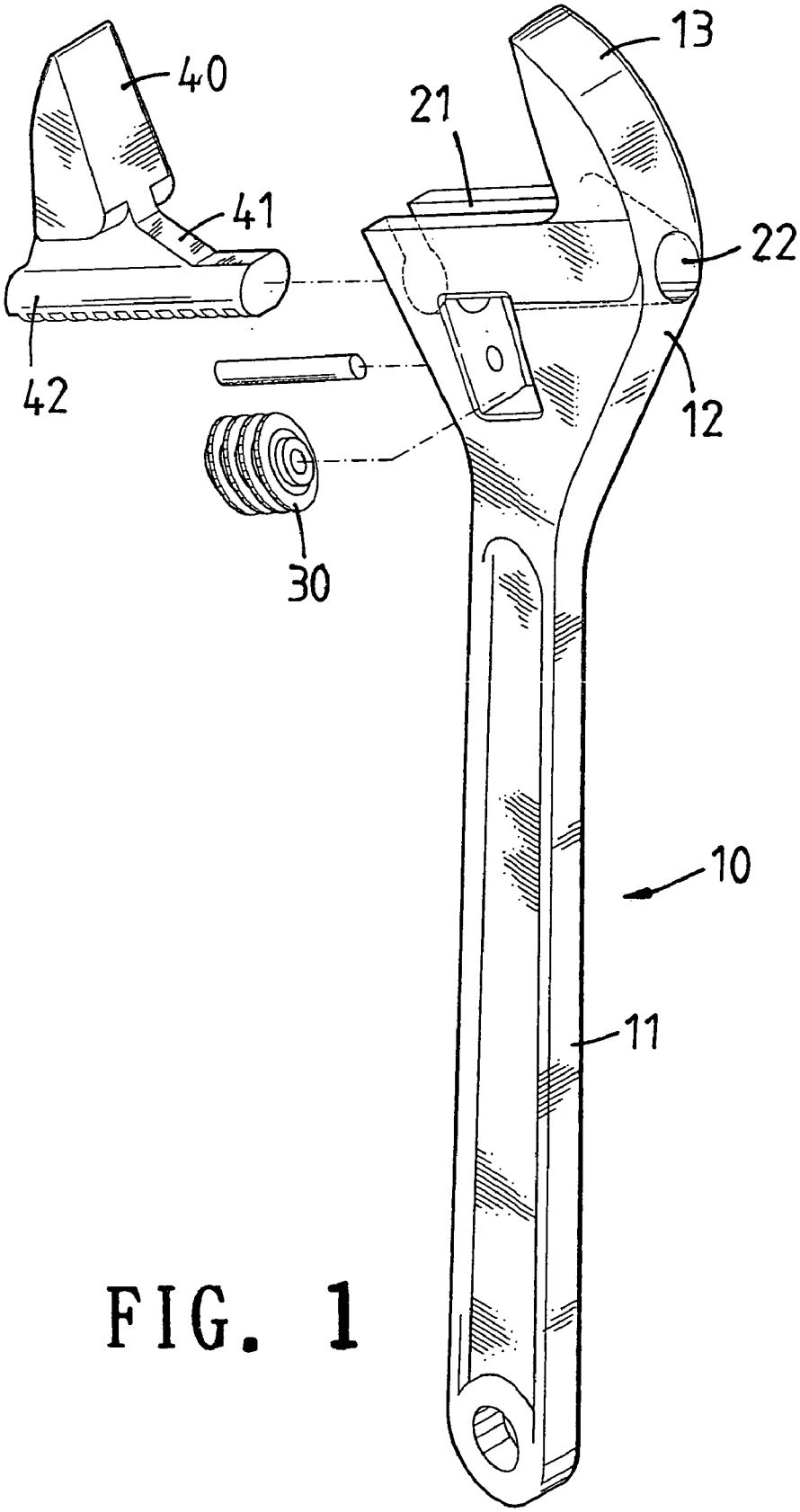
FIG. 1 is an exploded view to show the adjustable wrench of the present invention.
Figure 2:
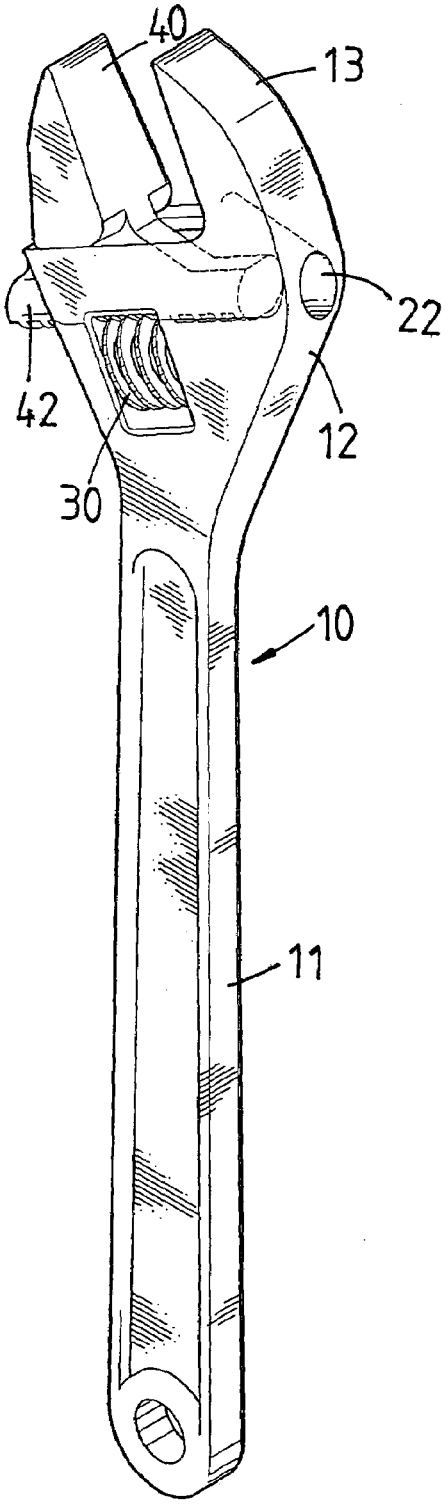
FIG. 2 shows that the movable jaw is located at a distance from the fixed jaw of the wrench of the present invention.
Figure 3:
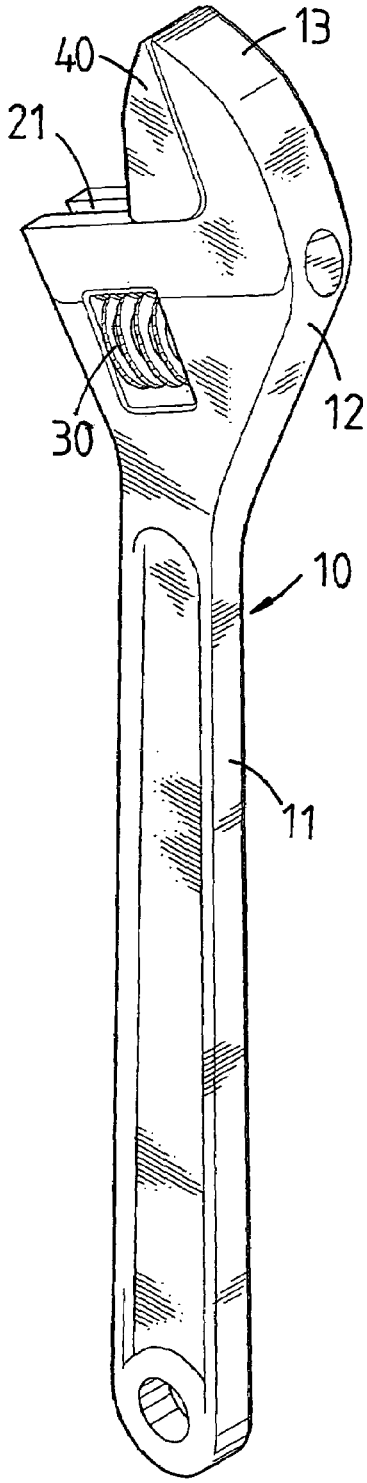
FIG. 3 shows that the movable jaw is matched with the fixed jaw of the wrench of the present invention.
Figure 5:
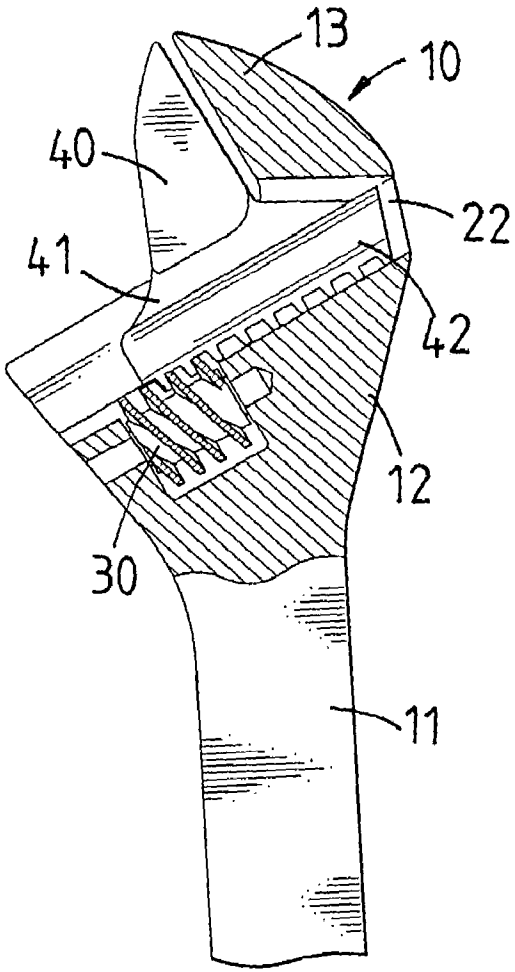
FIG. 5 is a cross sectional view to show the movable jaw is located to match with the fixed jaw of the wrench of the present invention.
Figure 4:
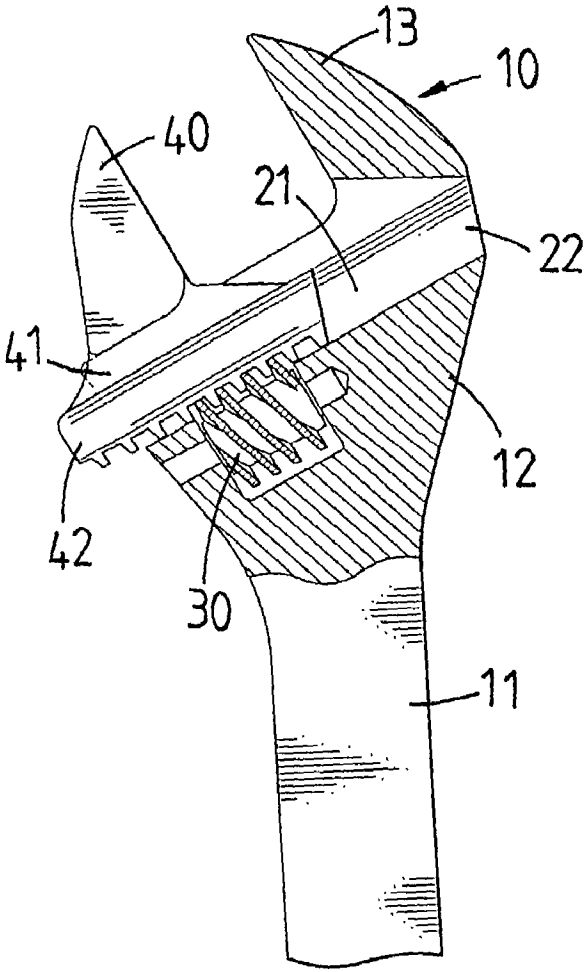
FIG. 4 is a cross sectional view to show the movable jaw is located at a distance from the fixed jaw of the wrench of the present invention.
Figure 6:
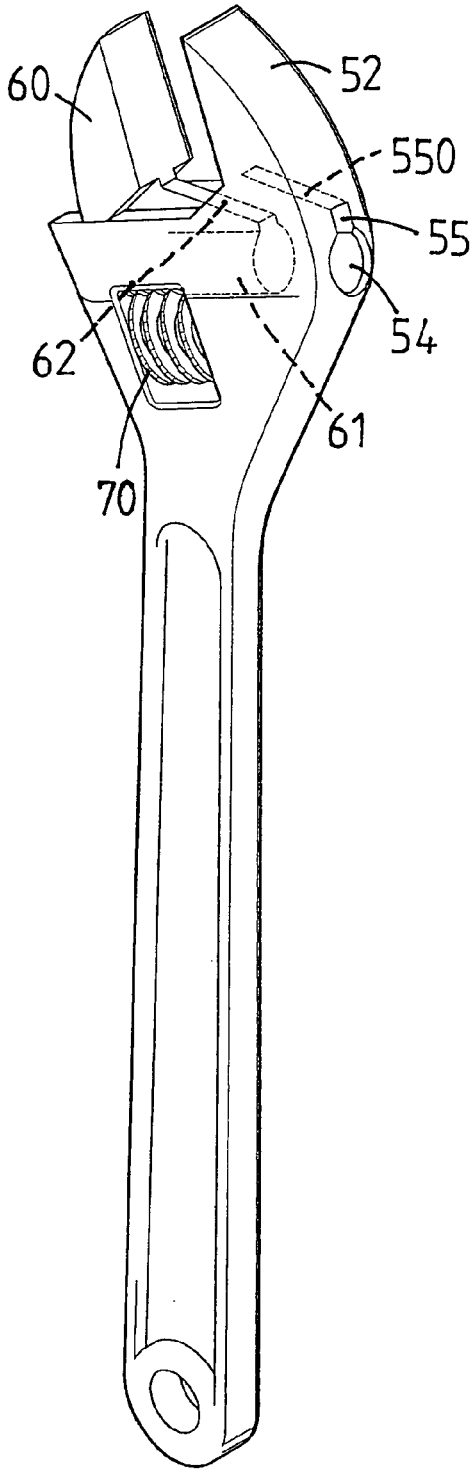
FIG. 6 PRIOR ART
FIG. 6 shows that the movable jaw is located at a distance from the fixed jaw of a conventional adjustable wrench.
Figure 7:
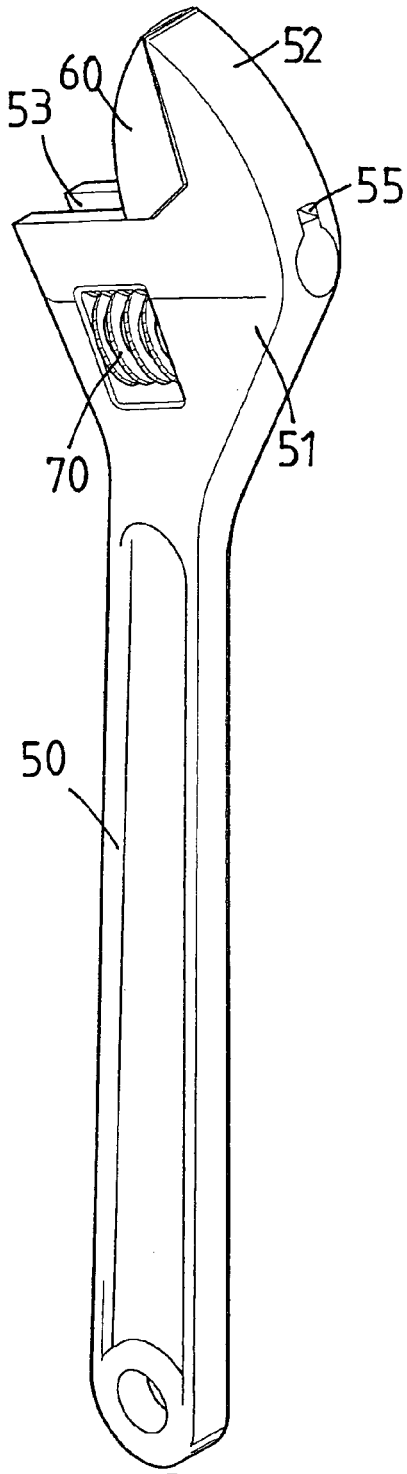
FIG. 7 PRIOR ART
FIG. 7 shows that the movable jaw is matched with the fixed jaw of the conventional adjustable wrench.

Referring to FIGS. 1 to 5, the adjustable wrench of the present invention comprises a handle 11 and a head 12 is integrally connected to an end of the handle 11. A fixed jaw 13 extends from the head 12 and a groove 21 is defined in an end of the head 12. A through hole 22 is defined transversely through the fixed jaw 13 and located in parallel to the groove 21. The through hole 22 communicates with the groove 21 and forms a circular hole in an outer surface of the head 12.

A movable jaw 40 has a cylindrical rack piece 42 which has teeth defined in one side thereof and a flange 41 extends from a root portion of the movable jaw 40 and ends at a distance from a distal end of the rack piece 42. The rack piece 42 is movably inserted in the groove 21 and the through hole 22. A thumb screw 30 is rotatably engaged with a hole defined through the head 12 by a pin and engage with the rack piece 42. The movable jaw 40 moves by rotating the thumb screw 30.

It is noted that the circular hole in the head 12 is easily made compared with the recess and the hole of the conventional wrench. The structural strength of the fixed jaw 13 is reinforced when compared with the conventional fixed jaw.

While we have shown and described the embodiment in accordance with the present invention, it should be clear to those skilled in the art that further embodiments may be made without departing from the scope of the present invention.

What is claimed is:

1. An adjustable wrench (10) comprising:

a handle (11) and a head (12) connected to an end of the handle (11), a fixed jaw (13) extending from the head (12) and a groove (21) defined in an end of the head (12), a through hole (22) defined transversely through the head (12) and communicating with the groove (21), the through hole (22) forming a circular hole in an outer surface of the head (12);

a movable jaw (40) having a cylindrical rack piece (42) and a flange (41) connected between the movable jaw (40) and the rack piece (42), the flange (41) extending from a root portion of the movable jaw (40) and ending at a distance from a distal end of the rack piece (42), the rack piece (42) movably inserted in the groove (21) and the through hole (22), and a thumb screw (30) rotatably engaged with a hole defined through the head (12) and engage with the rack piece (42).

* * * * *